US006763646B1

(12) United States Patent
Bonomo

(10) Patent No.: US 6,763,646 B1
(45) Date of Patent: Jul. 20, 2004

(54) METHOD AND ELEMENT FOR INTRODUCING SHEAR FORCES INTO A CONCRETE BODY, AND CONCRETE BODY

(76) Inventor: Reto Bonomo, Mitteldorf 78, CH8455 Rudlingen (CH)

( * ) Notice: Subject to any disclaimer, the term of this patent is extended or adjusted under 35 U.S.C. 154(b) by 0 days.

(21) Appl. No.: 09/666,998

(22) Filed: Sep. 21, 2000

(51) Int. Cl.[7] ..... E04C 3/34

(52) U.S. Cl. ..... 52/724.1; 52/724.2; 52/600; 52/260; 52/223.4; 52/431; 52/435

(58) Field of Search ..... 52/724.1, 724.2, 52/20, 21, 167.1, 721.1, 600, 260, 742.16, 259, 223.1, 223.4, 223.5, 223.8, 223.9, 223.14, 431, 432, 434, 435

(56) References Cited

U.S. PATENT DOCUMENTS

| | | | | | |
|---|---|---|---|---|---|
| 2,754,674 | A | * | 7/1956 | Malsbury et al. | 52/724.1 |
| 3,478,481 | A | * | 11/1969 | Heierli et al. | 52/167.1 |
| 3,691,710 | A | * | 9/1972 | Gilbert et al. | 52/724.1 |
| 5,119,614 | A | * | 6/1992 | Rex | 52/432 |
| 6,062,560 | A | * | 5/2000 | Peterson | 273/108 |
| 6,129,483 | A | * | 10/2000 | Juracko | 405/132 |
| 6,327,825 | B1 | * | 12/2001 | Sanders et al. | 52/167.1 |

FOREIGN PATENT DOCUMENTS

| | | | | |
|---|---|---|---|---|
| DE | 9001016 | | 1/1990 | |
| EP | 0685613 | | 5/1995 | |
| EP | 0692574 | | 6/1995 | |
| EP | 0773324 B1 | * | 7/1995 | E01C/11/14 |
| EP | 0773324 B1 | | 10/1996 | |
| FR | 332.797 | | 11/1903 | |
| FR | 1.323.763 | | 3/1962 | |
| JP | 6-306930 | * | 4/1993 | E04B/1/04 |
| JP | 5-280091 | * | 10/1993 | E04B/1/16 |
| JP | 6-108534 | * | 4/1994 | E04B/1/21 |
| JP | 6-108588 | * | 4/1994 | E04C/5/18 |

* cited by examiner

*Primary Examiner*—Carl D. Friedman
*Assistant Examiner*—Chi Q Nguyen
(74) *Attorney, Agent, or Firm*—William A. Simons; Wiggin and Dana

(57) ABSTRACT

In an element (40*b*) for introducing shear forces into a concrete body a loop element (43*b*) is arranged on a shear force mandrel (41*b*), which loop element has an arc section (47*b*) in proximity to the surface of the concrete. When the element (40*b*) is subjected to a shear force (arrow 53) the arc section (47*b*) transmits this force to the concrete core inside the arc only through tensile forces in the loop element (43*b*) or in the arc element (47*b*). To absorb the resulting moment a second arc element (57*b*) aligned in the opposite direction is advantageously provided behind the first arc element (47*b*).

27 Claims, 10 Drawing Sheets

METHOD AND ELEMENT FOR INTRODUCING SHEAR FORCES INTO A CONCRETE BODY, AND CONCRETE BODY

BACKGROUND OF THE INVENTION

1. The Technical Field of the Invention

The present invention concerns a method of introducing shear forces into a concrete body, in particular, through the side face of a concrete slab, in which the force is absorbed by an axially extended shear force rod, e.g. a shear force mandrel or a sleeve around the shear force mandrel, is diverted from the shear force rod by a shear force strap connected to the shear force rod at at least one point close to the surface of the concrete and one point distant from the surface of the concrete and is transmitted to the concrete.

The invention also concerns an element for introducing shear forces into a concrete body, in particular, through the side face of a concrete slab, with an axial shear force rod, e.g. a shear force mandrel or a sleeve around the shear force mandrel, and with a shear force strap fixed to the shear force rod at at least one point close to the surface of the concrete and one point distant from the surface of the concrete, for transmitting shear force to the concrete, and it also concerns a concrete body with a shear force element according to the invention.

2. Brief Description of Art

The most diverse forms of shear force absorbing pins are known, in which the cross section of the pin is increased in the stressed zones in order to reduce the local compressive forces occurring at the transition between pin and concrete. However, the load capacity of the concrete slab is reduced by the proximity of these pins to the surface of the concrete on the compression side.

An "Investigation into shear pins of reinforcing steel embedded in concrete" published in 1983 in Vol. 346 of the "Deutscher Ausschuss für Stahlbau" examined ten different reinforcements by which the shear forces introduced into the side face of a concrete body could be distributed in order to increase the load capacity of a concrete slab in the zone of the shear forces introduced. It emerged from this that only two of the test arrangements examined were fully effective. These were two-shear, rearwardly anchored loops in direct centric contact with the shear pin (p. 144, right column, paragraph 2). These loops were made of round steel bars at least 10 mm thick.

Because unified solutions are often more economic than individual ones on construction sites, prefabricated elements have been developed which can be incorporated in the shuttering as ready-made products. In the specialized trade two elements for introducing shear forces are known in particular, and are described below with reference to FIGS. 1 to 3.

The shear force strap in FIGS. 1 and 2 is shown cast into a concrete slab 10 and has a steel plate 13 placed in the side face of the concrete slab 11 and two straps 15, 15' welded to this steel plate. Plate 13 has a central opening 17 in which a mandrel 19 is inserted. The two straps 15, 15' are set parallel to each other and away from the concrete surface of plate 13 and, at a distance from the mandrel axis 21, are bent in a direction parallel to the mandrel axis 21. The end portions 23 of the reinforcing steel forming the straps 15, 15' are bent through about 165 to 170 degrees at a relatively large distance from the side face of the slab 11 and return to meet the end of mandrel 19 about halfway back to the side face of the slab. The straps 15, 15' are formed symmetrically to axis 21, so that shear forces in two opposite directions can be transmitted to the concrete slab by the same strap. The four ends 23 of the straps are linked to each other and to the mandrel 19.

A part of the force (arrow 25) introduced into this strap via the shear force mandrel is transmitted as tensile force to the upper part of strap 15. Because of the eccentric introduction of the force into the mandrel, said mandrel has a tendency to twist away, so that it transfers compression forces to the ends 23 of the upper part of straps 15, 15'. Bending forces act, in particular, on the horizontal part of the strap. In addition, a part of the force introduced is transmitted to strap 15 as compression force in the lower part of strap 15. This compression force is transmitted to the concrete slab 10 in the vicinity of the underside 27 of the slab.

The strap 15 shown in FIGS. 1 and 2 is a two-shear loop anchored rearwards with direct centric contact to the mandrel, and differs from the arrangements which have proven effective in the study mentioned only in that the rearwardly anchored reinforcing rods 15, 15' are in centric contact with the mandrel by means of a plate 13 and in that the ends 17 are bent round and fixed to the mandrel.

The device 31 shown in FIG. 3 acts in a similar way to the device in FIGS. 1 and 2. Tensile and compressive forces are transmitted by the shear force mandrel 32 via the rigid plate 33 on the side face of a concrete slab to the two arms 35 of the flat steel strap 37 formed symmetrically on either side of the mandrel 32, which arms are welded to plate 33. Bending forces which are difficult to calculate occur in the strap arms 35, which extend into the concrete in a convergent direction from plate 33 and are fixed to the shear force mandrel 32 at a distance from plate 33. Here, too, the compressive forces are transmitted to the concrete lying in the direction of the pressure close to the surface of the concrete.

A disadvantageous feature of these prefabricated elements is that compressive forces arise close to the surface of the concrete on the compression side. There is therefore a danger that fragments of concrete will split away. A further disadvantage is that the resulting flow of forces in the concrete remains unclear. The forces arising can hardly be calculated, since the calculations cannot be based on any simple model.

It is therefore the objective of the invention to create a method and a device for introducing shear forces into a concrete body whereby the introduction into the concrete of compressive forces close to the surfaces of the concrete and directed towards these surfaces is avoided. Furthermore, the device shall be capable of being formed symmetrically, so that incorrect insertion of the device on the construction site is made impossible. In addition, the forces are to be calculable according to a simple model.

BRIEF DESCRIPTION OF THE INVENTION

This objective is achieved according to the invention in that, in a method of the type mentioned at the outset, the strap is so formed around a concrete core forming part of the concrete body that substantially only tensile forces can arise in the strap. The strap is advantageously formed in an arc around the concrete core. Thereby the compressive forces in the concrete occur inside the arc section. As the arc section is arranged on the tension side, and if the shear force rod is arranged at approximately the center of the thickness of the slab, a larger part of the slab's thickness certainly lies on the compression side than on the tension side of the strap.

The arc, preferably of flat material, is advantageously formed symmetrically around the concrete core. The symmetry permits simpler calculation of the forces arising, as the components aligned perpendicularly to the axis of symmetry cancel each other out. The sum of the force vectors therefore forms a vector on the axis of symmetry. The loading on the concrete is especially consistent when a planar arc section is used, as only compressive forces arise in the concrete, similarly to those in a vault. A planar arc section has the advantage of smaller local compressive forces and a three-dimensional play of forces, increasing the local load capacity of the concrete.

Advantageously, a first strap or strap section connected to the shear force rod is formed around a concrete core close to the surface of the concrete, and a second strap or strap section connected to the shear force rod is formed around a concrete core distant from the surface of the concrete. In this way the moment arising from the eccentric loading of the shear force rod can be absorbed.

Advantageously the tensions arising in the concrete core are distributed by means of an additional reinforcement in the concrete. This is especially indicated in a corner of a concrete slab, as the forces arising in the concrete in that area perpendicularly to the side face of the concrete slab are directed outside the face set at an angle to it beyond the corner of the slab. These outwardly directed compressive forces must be absorbed by a reinforcement. But the compressive forces arising at a greater distance from a corner are also advantageously distributed by reinforcements in the concrete slab. Normally such a reinforcement comprises standard slab edge strapping with U-shaped straps, the legs of which are arranged parallel to the plane of the slab and perpendicularly to the face of the slab. At a corner the straps are arranged at an angle to each other corresponding to the angle of the corner and are interlocked. The legs of the straps can also be connected by steel bars arranged parallel to the face of the slab. Advantageously, however, fiber reinforcement is used, as this also increases the compressive strength of the concrete.

In the case of an element for introducing shear forces into a concrete body, especially through the side face of a concrete slab, with an axial shear force rod, e.g. a shear force mandrel or a sleeve around the shear force mandrel, and with a shear force strap attached to the shear force rod at at least one point close to the surface of the concrete and one point distant from the surface of the concrete, the strap according to the invention is a loop element for transmitting shear force to the concrete, the sections of which element attached to the shear force rod are linked by an arc section at a distance from the shear force rod.

The strap is outstandingly suited to translating tensile forces in the arc element into compressive forces in the core contained inside the arc. Advantageously, the loop element is flexible enough under load from the forces arising that is absorbs substantially only tensile forces. It can comprise, for example, a chain, a steel cable or steel mesh, sheet metal, or a glass fiber or carbon fiber structure or suchlike element. A fixed connection with high friction between the loop element and concrete is not desirable, as the loop, because of its form and loading, is intended to transmit only compressive forces to the concrete core which it encloses.

The loop element preferably has a symmetrical arc section, e.g. an arc section with, for example, a circular, elliptical or parabolic arc. The forces in such a symmetrical or geometrically defined arc section, and the forces induced in the concrete by this arc section, can be calculated with simple models.

The loop element advantageously has a curved planar element in the arc section zone, so that the local forces are as small as possible.

The loop element is preferably formed of a strip which is relatively wide in relation to its thickness. Such a strip can absorb practically no compressive forces in the direction of the strip, as it is too thin. Its total cross section, however, permits appropriate tensile forces in the strip, so that high pressures can be transmitted to a concrete core around which the strip is formed. Because of the flexibility of the strip it can be assumed when making calculations that the strip is formed around a virtual roller, so that no unilateral tension on the strip is possible. For this reason the distribution of pressure in the concrete core inside the loop is very simple.

The arc section is advantageously curved substantially around an axis parallel to the surface of the concrete, and at least one of the sections of the loop element connected to the shear force rod is so bent or twisted that the bent or twisted part touches the shear force rod along a line or plane parallel to the axis of the shear force rod. Because of the parallelism of the arc axis to the surface of the concrete, the forces are distributed parallelly to the face of the concrete. For this reason the compressive forces are not directed towards the surface of the concrete, which is practically incapable of absorbing such compressive forces. Because of the linear or planar contact between the shear force rod and the loop element a very good possibility of attachment is provided.

Advantageously, the two sections of a loop element attached to the shear force rod run practically parallel. As a result, especially if the two sections are arranged at a short distance from each other, an even distribution of forces in the loop can be assumed. Alternatively, the section close to the surface of the concrete is aligned parallel to the surface of the concrete, i.e. to the side face of the concrete slab, and the section of the arc section distant from the surface of the concrete is aligned towards the interior of the concrete and towards the shear force rod and away from the side face. In this way the resulting compressive load on the concrete core surrounded by the loop is a vector directed towards the interior of the concrete.

Advantageously, holes or eyes are arranged in the section of the loop element close to the surface of the concrete and connected to the shear force rod, so that the shear force element can be attached to concrete shuttering with nails through the holes. For this purpose the section of the strap close to the surface of the concrete advantageously projects in one place beyond the corresponding point of the section distant from the concrete surface, and holes are provided in the strap at this projecting point, so that the strap can be attached to shuttering through the holes.

The loop element is advantageously formed symmetrically in relation to the axis of the shear force rod, so that shear forces in two opposite directions can be conducted into the concrete. In addition, this enables the element to be correctly positioned on the construction site with greater security.

The shear force rod advantageously has a zone extending into the concrete which is about twice as long as the distance between the two fixing points of the loop element to the shear force rod, or, if applicable, between the two fixing points closer to the surface of the concrete, so that practically the same stress can be assumed at both attachment points of the loop element.

Advantageously, an arc section is arranged rearwards of the arc section close to the surface of the concrete, which first arc section is aligned in the opposite direction. This inner arc section absorbs transverse forces in the same way as the outer section, but acting in the opposite direction. This prevents rotation of the shear force rod under eccentric loading of the rod.

Advantageously, the diameter of the arc section lying parallel to the axis of the shear force rod is smaller than the distance of the furthest point of the arc section from the shear force rod. In this way the largest compressive forces are applied on the tension side of the shear force rod and thus are applied at a relatively large distance from the surface of the concrete on the compression side.

A concrete body with a shear force element according to the invention is advantageously reinforced by a fiber reinforcement in the zone around the shear force elements. The fiber reinforcement can increase both the tensile and the compressive strength of the concrete.

The concrete body is advantageously a prefabricated element and reinforcements project from the element by means of which the element can be combined with a concrete body cast on site. Through the use of a prefabricated element the separate treatment of the edge zone of a concrete body when casting the concrete body can be avoided. Therefore, monitoring on site of the feeding of the fibers into the concrete into which the shear force elements are cast is not required. Prefabrication permits efficient manufacture of the edge elements under conditions which allow their quality to be guaranteed.

DETAILED DESCRIPTION OF PREFERRED EMBODIMENTS OF THE INVENTION

Figure 1:
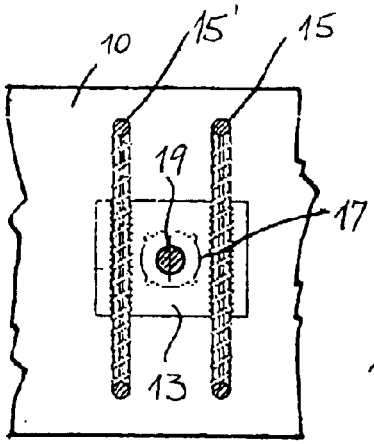
FIG. 1 shows a shear force element according to the state of the art, with straps of reinforcing steel.
Figure 2:
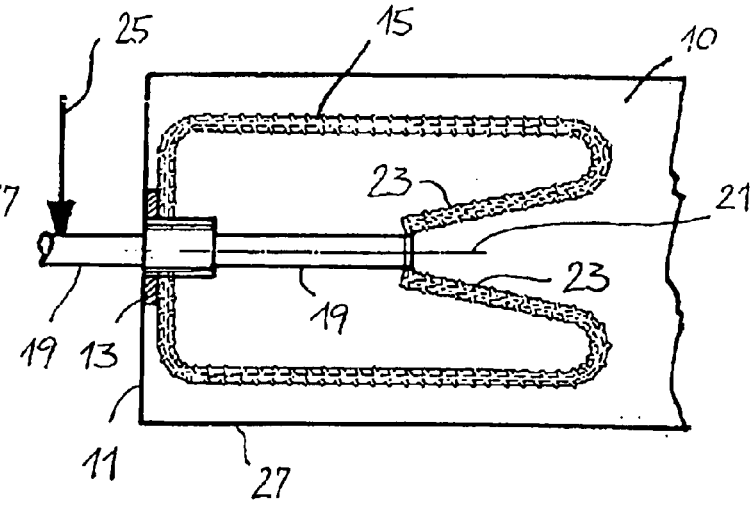
PRIOR ART Fig. 2
FIG. 2 shows a side view of the shear force element according to FIG. 1.
Figure 3:
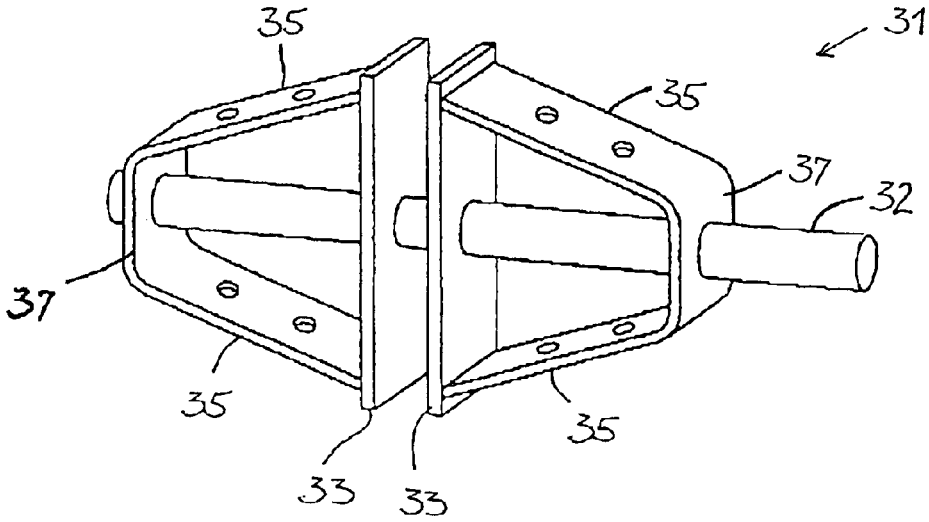
PRIOR ART Fig. 3
FIG. 3 shows a shear force element according to the state of the art, with a shear force strap of flat steel.

FIGS. 1 to 3 show the state of the art, as described in more detail at the outset. From FIG. 4 onwards examples of embodiments of the invention are shown, which will be described in more detail below for better understanding of the invention.

Figure 4:
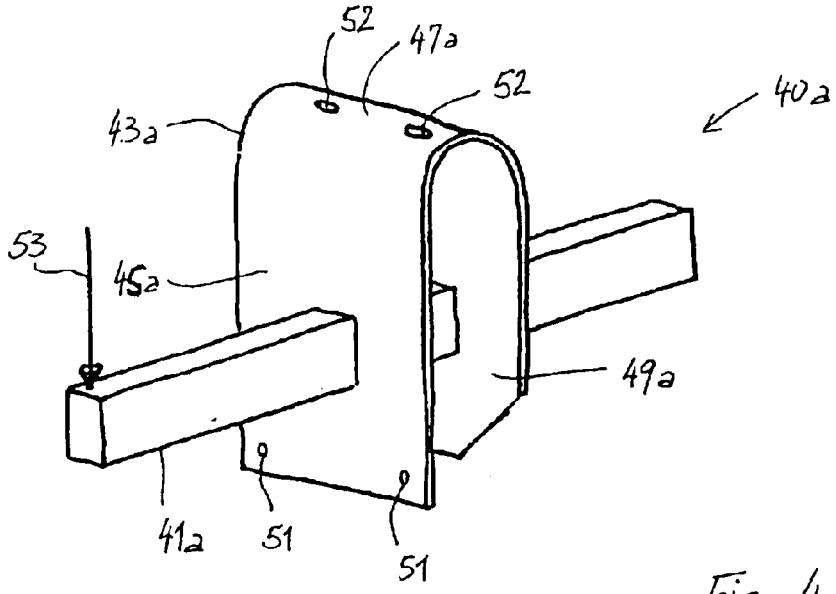
FIG. 4 is a perspective sketch of a simple embodiment of the invention.

FIG. 4 shows a shear force element 40*a* with a shear force mandrel 41*a* with a rectangular cross section on which a curved flat steel strip 43*a* is fitted as a shear force strap. The steel strip 43*a* has a flat leg section 45*a* to be placed on the front side and fixed to the mandrel 41*a*. Leg section 45*a* passes over into a curved arc section 47*a*, which passes over into a leg section 49*a* parallel to leg section 45*a*. This section 49*a* of the steel strip 43*a* set at a distance from the side face of the concrete is connected to mandrel 41*a*. Steel strip 43*a* is therefore connected to mandrel 41*a* by leg section 45*a* near the surface of the concrete and by leg section 49*a* in the interior of the concrete. Mandrel 41*a* projects beyond section 45*a*, which is to be placed in the surface of the concrete, in order to absorb or to transmit a transverse force, and extends significantly beyond section 49*a* into the concrete zone. On leg section 49*a* two corners of the strip 43*a* are cut off and corresponding holes 51 are provided in the corresponding corners of leg section 45*a*, so that the shear force element 40*a* can be fixed to shuttering by means of these holes 51. In arc section 47*a* of strap 43*a* holes 52 are also provided, so that no air bubbles, which would prevent a good transmission of forces between arc section 47*a* and the concrete, can be trapped under the arc section.

If a force acts on the cast-in mandrel 41*a* in the direction of arrow 53, tensile forces arise in leg sections 45*a* and 49*a*, so that arc section 47*a* is tensioned around the concrete core contained inside it. This gives rise to symmetrical compressive forces in the concrete core, the resultant vector of which lies on the median line between the two leg sections 45*a* and 49*a*. In the example of FIG. 4 it therefore runs parallel to the two leg sections 45*a* and 49*a* and therefore also parallel to the surface of the concrete.

As the application of the force (arrow 53) and the transmission of the force to the concrete occur at a distance from each other, a turning moment seeking to rotate the mandrel 41*a* in an anticlockwise direction is produced. As the mandrel is embedded rearwards in the concrete, such rotation is prevented. The mandrel accordingly transmits a force to the concrete in the opposite direction to the force applied (arrow 53). In order for equilibrium to exist in shear force element 40*a*, the concrete must exert on the end of the mandrel 41*a* embedded in it a counter-moment (force in arrow 53 multiplied by the distance of the arrow from the central plane of loop element 43*a*) corresponding to the induced moment.

Figure 5:
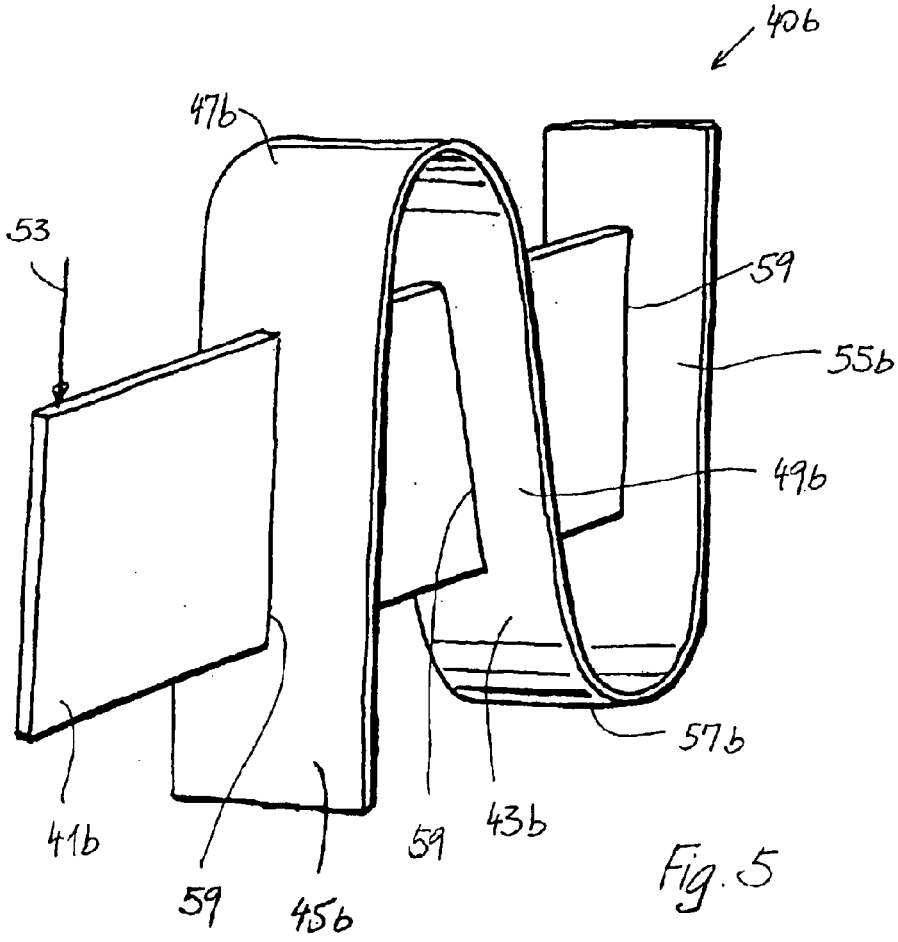
FIG. 5 is a perspective sketch of a shear force element with an S-shaped double loop.

To transmit this counter-moment the two transverse forces acting at reciprocal distances on the mandrel can be transmitted by a loop 43*a*. To achieve this it is only necessary to fit to the rearward end of the mandrel a second loop 43*a* aligned in the opposite direction. FIG. 5 shows a shear force element 40*b* with such a double loop 43*b* on a shear force plate 41*b*. Shear force plate 41*b* passes through the three leg sections 45*b*, 49*b* and 55*b*. Arc sections 47*b* and 57*b* are provided between leg sections 45*b* and 49*b* and 49*b* and 55*b* respectively. Again according to the invention, compressive forces are exerted on the concrete only through tensile forces in the loop element 43*b*, by means of these arc sections 47*b*, 57*b*. Leg section 49*b* is slightly inclined, i.e. its transition to the front arc section 47*b* is closer to the surface of the concrete through which the force is introduced than its transition to the rearward arc section 57*b*. In the case of a short configuration it can also be appropriate to form the middle leg section 49*b* to be inclined in the other direction, so that the depth of element 40*b* inside the concrete body is less than the sum of the diameters of the two arc sections 47*b* and 57*b*.

The configuration of the shear force mandrel as plate 41*b* has the advantage that mandrel 41*b* can carry high loads in the load direction 53 and that the loop element 43*b* can be connected to mandrel 41*b* by means of long, load-carrying weld seams 59.

Figure 6:
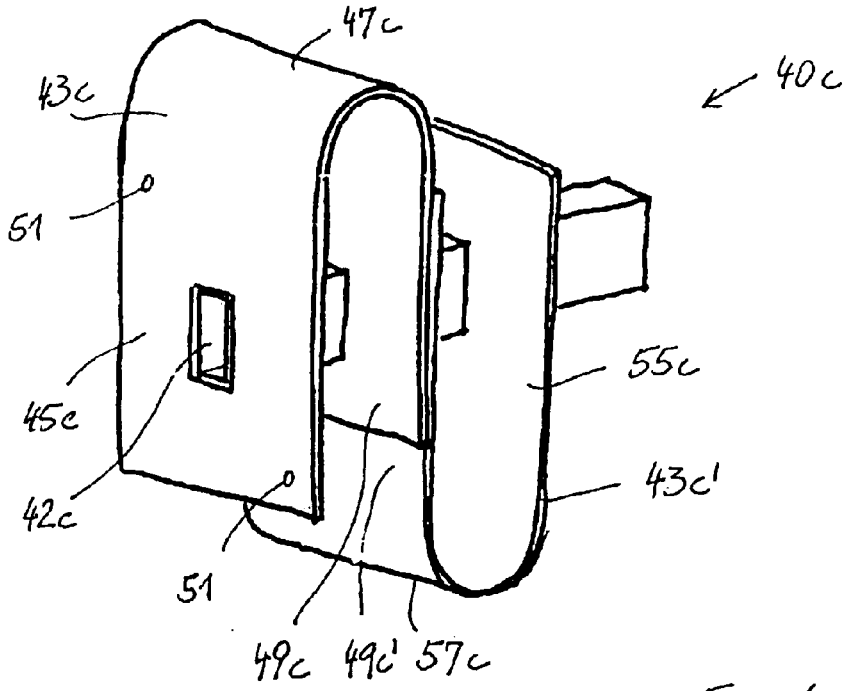
FIG. 6 is a perspective sketch of a shear force element with an S-shaped loop which is composed of two equal loop elements.

As shown in FIG. 6, the double loop 43*b* can also be composed of two independent loops 43*c*, 43*c*'. Here a sleeve 42*c* is passed through two shear force straps or loops 43*c*, 43*c*' aligned in opposite directions, in which sleeve 42*c* a shear force mandrel can be inserted.

Figure 7:
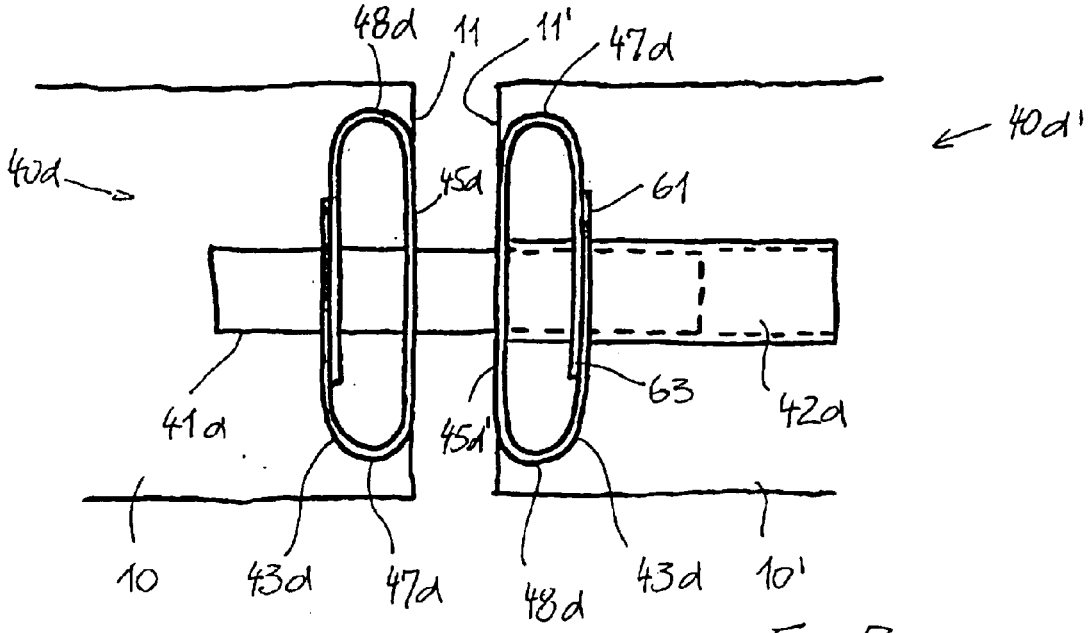
FIG. 7 shows an arrangement of two symmetrical shear force elements in two adjacent slab edges.

As shown in the example in FIG. 7, shear force elements 40*d* and 40*d*' are cast, for example, in two concrete slabs 10 and 10' respectively. Both on the shear force mandrel 41*d* in the first slab 10 and on the shear force sleeve 42*d* in the second slab 10' a loop element 43*d* is arranged. The leg sections 45*d* of the loop elements 43*d* are arranged directly on both sides of the joint between the two slabs 10, 10', or on the side faces 11, 11' of the slabs. Shear force mandrel 41*d* bridges the joint and engages in the shear force sleeve 42*d*.

In the example the loop elements 43*d* are configured symmetrically, i.e. they can absorb shear forces in two opposite directions, as they have an arc section 47*d* and 48*d* on each side of mandrel 41*d* and of sleeve 42*d* respectively. If a shear force is transmitted downward by slab 10 to the supported slab 10', arc sections 47*d* are used to transmit the force, while, correspondingly, arc sections 48*d* are used to transmit forces in the opposite direction. The symmetrical loops 43*d* are formed from a strip, so that mandrel 41*d* and sleeve 42*d* are passed through the two strap ends 61 and 63 and these ends lie adjacent to each other and if necessary are additionally joined by welding or bonding. Compressive forces practically cannot arise in loop element 43*d* because of its configuration as a strip. There should not therefore be any fear of concrete fragments splitting off close to the concrete surface on the compression side.

Figure 8:
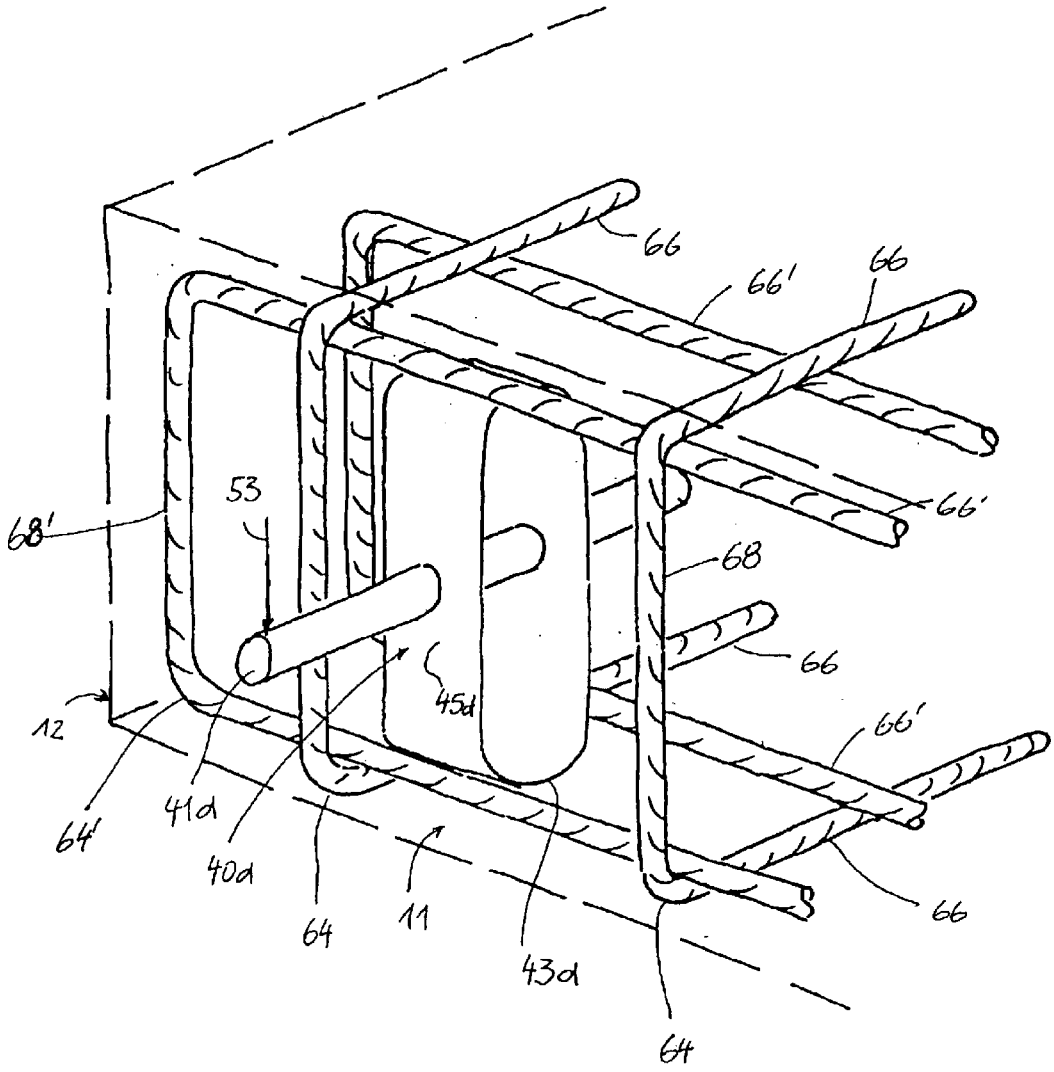
FIG. 8 is a perspective sketch of a shear force element with associated additional reinforcement.

FIG. 8 shows shear force element 40*d* according to FIG. 7 in conjunction with a reinforcement of a slab edge at a corner of a concrete slab. The section 45*d* of loop element 43*d* close to the surface of the concrete is arranged in side face 11 or a short distance behind face 11, the shear force mandrel 41*d* extending perpendicularly through face 11. The slab edge is reinforced with U-shaped straps 64, the arms 66 of which are aligned perpendicular to face 11 close to the upper and lower surfaces of the slab. The link 68 between the arms 66 or legs runs parallel to the direction of the force 53 to be introduced into the side face 11. Further U-straps 64' are introduced vertically between the arms of U-straps 64, the arms 66' of which run parallel to side face 11 inside arms 66. The links 68' of strap arms 66' are aligned perpendicularly to the side face 12 beyond the corner and parallel to the axis of the mandrel. Thereby the downwardly directed compressive forces arising at the edge of the slab and on the underside of the slab are distributed by the reinforcement and connected to the upper reinforcement. If necessary a reinforcement bar can be pushed through the loops of loop element 43*d* in order to distribute the forces transmitted by the loop laterally and/or rearwards into the concrete.

Figure 19:
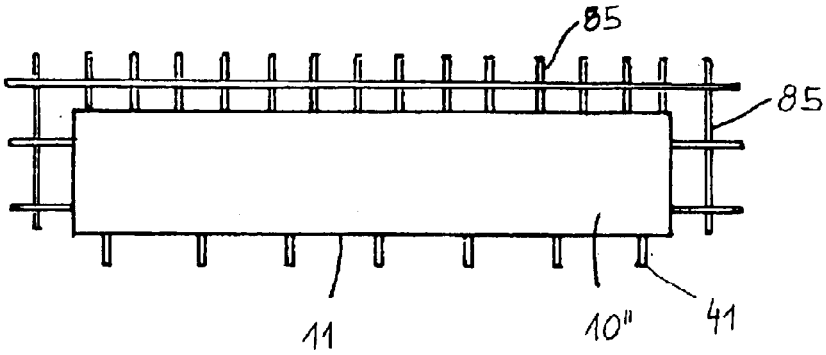
FIG. 19 shows a prefabricated edge element with a number of shear force elements.

However, reinforcement of the slab edge by fiber reinforcement, i.e. by adding glass or carbon fibers to the concrete mass is preferred. Slab portions reinforced in this way, as shown in FIG. 19, are advantageously prefabricated and joined to the concrete slab by suitable reinforcement.

Figure 9:
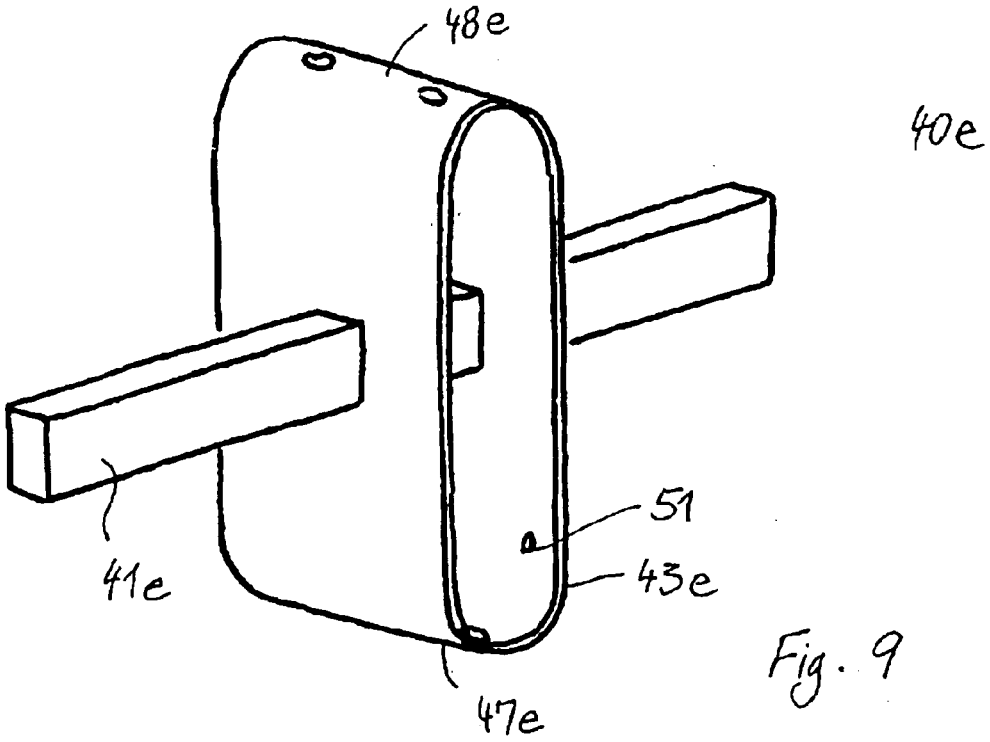
FIG. 9 is a perspective sketch of a symmetrical shear force element with mandrel.
Figure 10:
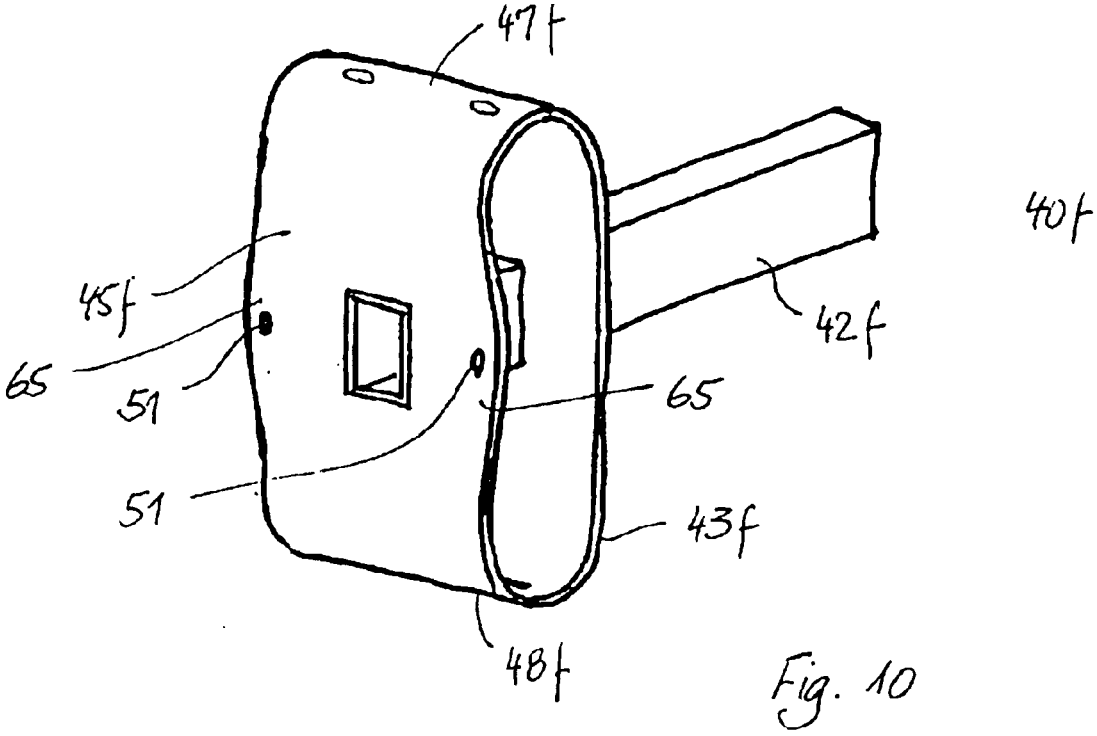
FIG. 10 is a perspective sketch of a shear force element with sleeve matching the shear force element according to FIG. 9.

FIGS. 9 and 10 show symmetrical loop elements 43*e* and 43*f*, which are formed by a flattened section of tubing. The shear force element 40*e* in FIG. 9 can be inserted into shear force element 40*f* in FIG. 10. Mandrel 41*e* cooperates with sleeve 42*f*. Holes 51 are provided in loop elements 43*e,f* in order to nail the shear force elements to shuttering. Holes 52 are incorporated in arc sections 47*e*, 48*e*, 47*f*, 48*f* so that the spaces inside loops 43*e,f* are entirely filled with concrete when casting and no air bubbles are trapped against the inside faces of arc sections 47*e,f*, 48*e,f* which have to transmit compressive forces. Holes 51 for fixing the element to the shuttering are advantageously formed in a laterally projecting bracket 65 on leg section 45*f*, so that they are easily accessible.

Figure 11:
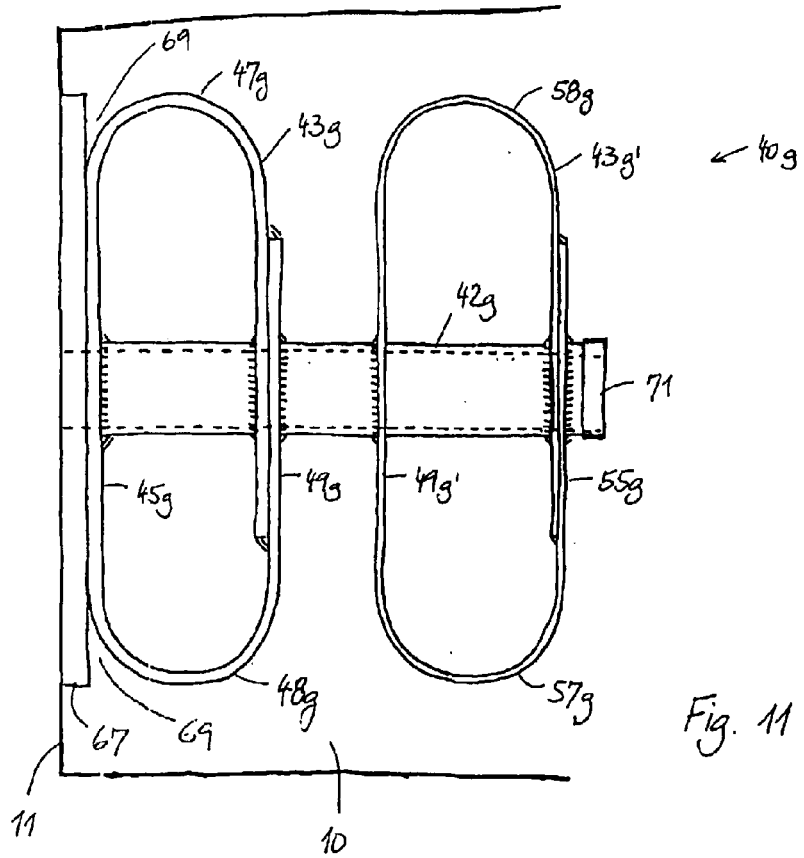
FIG. 11 shows a symmetrical shear force element with a front and rear loop element.

In FIG. 11 a symmetrical shear force element 40*g* is shown, with two symmetrical loop elements 43*g* and 43*g*' placed one behind the other. Sleeve 42*g* is passed through all the leg sections 45*g*, 49*g*, 49*g*', 55*g*. Leg section 45*g* is reinforced by a plate 67. This plate 67 lies in the side face 11 of a concrete slab 10. In addition the concrete ridges 69 between the concrete surface 11 and arc sections 47*g*, 48*g*, produced by the arcs of arc sections 47*g*, 48*g* and tapering to zero thickness, are protected by plate 67. However, these ridges 69 do not have any static function and could break off, or do not need to be filled with concrete at all. As lower forces act on loop element 43*g*', distant from the slab face, than on loop element 43*g* close to the face, loop 43*g*' is made of thinner steel strip. The embedded end of sleeve 42*g* is closed with a cover 71 so that concrete cannot enter the sleeve.

Figure 12:
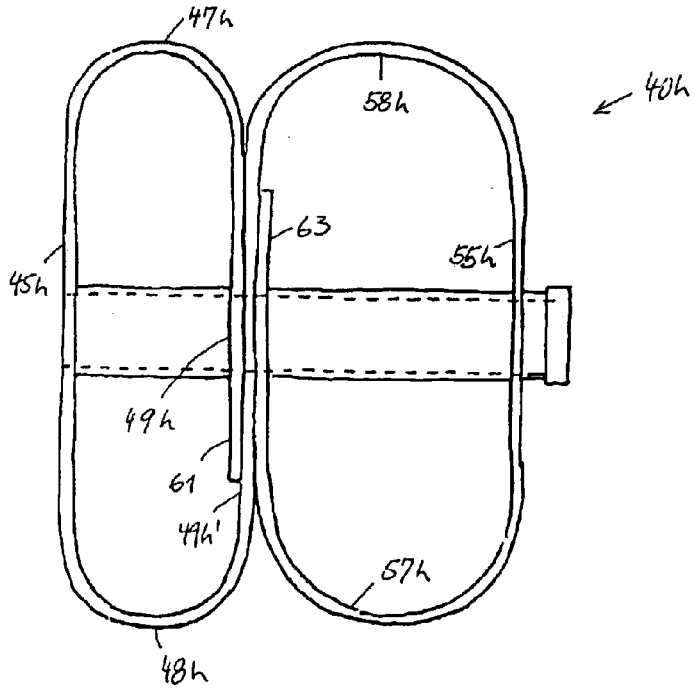
FIG. 12 shows a variant of the shear force element according to FIG. 11, in which the front and rear loops are formed of one strip.

A symmetrical double loop can be formed from a single strip, as shown in FIG. 12. This begins with an end 61 of leg section 49*h* and passes over with an arc section 47*h* into leg section 45*h*, which is to be placed at the surface of the concrete. From there an arc section 48*h* leads the strip rearwards again. The following leg section 49*h*' runs through behind the strip end 61, then passes over into an arc section 58*h* and into the rearmost leg section 55*h*, and from there into a further arc 57*h* and back into the middle to join leg sections 49*h*, 49*h*'. Sleeve 42*h* therefore passes through the figure-eight-shaped strip five times.

Figure 13:
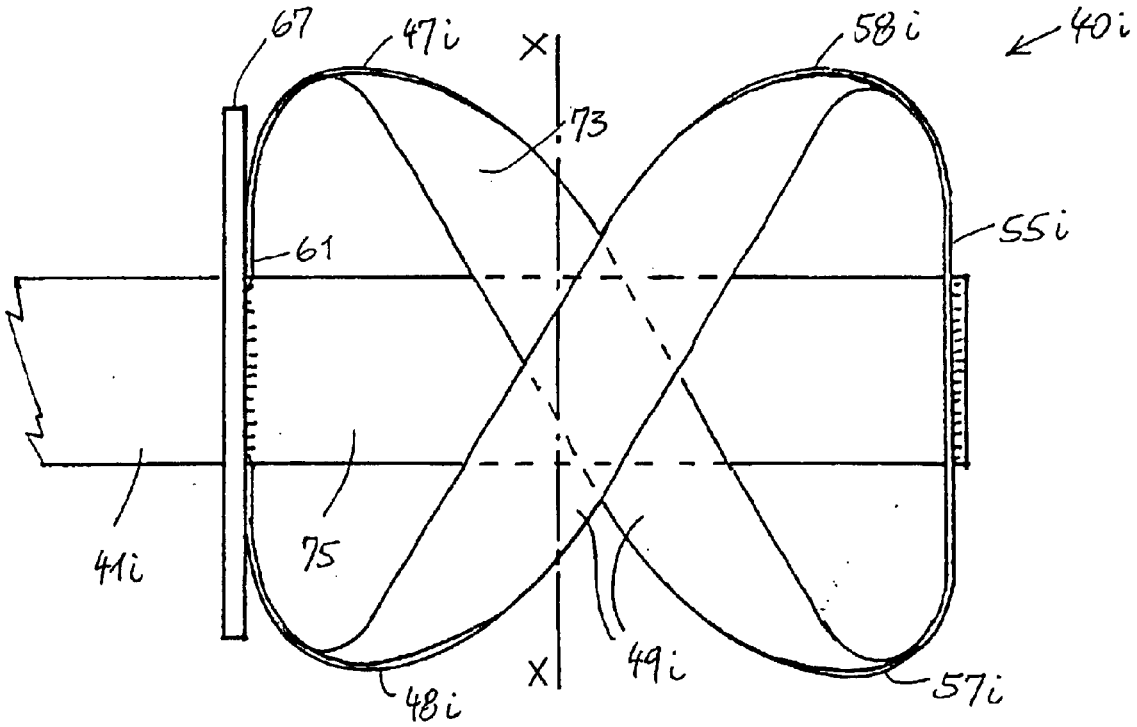
FIG. 13 shows a shear force element with two symmetrical loop elements forming a figure of eight.
Figure 14:
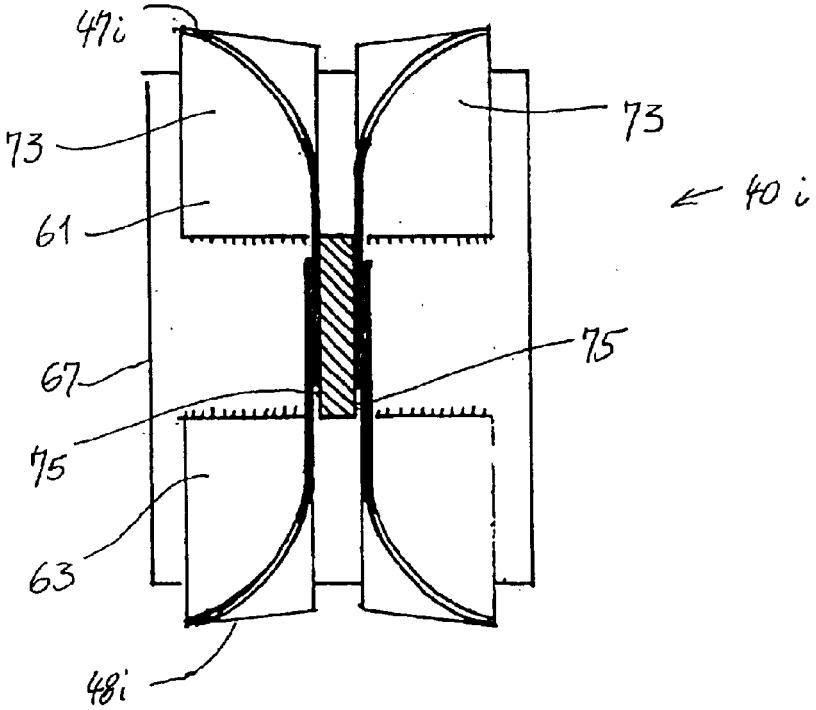
FIG. 14 shows a section along the line X—X through the shear force element according to FIG. 13.

In FIGS. 13 and 14 a shear force element 40*i* is shown in a side view and in a section along the line X—X in FIG. 13 respectively. A strip formed into a figure eight is arranged on either side of a flat shear force mandrel 41*i*. Strip ends 61, 63 are welded to a plate 67 to be placed in the concrete face. From the first strip end 61 running away upwardly parallel to plate 67 the strip passes back in an arc 47*i* to mandrel 41*i*. It is so twisted that as it passes mandrel 41*i* the face 73 of the strip runs parallel to the side face 75 of the flat mandrel 41*i*. Continuing rearwards the strip twists in the opposite direction, running back in an arc 57*i* to mandrel 41' and then arriving back at plate 67 in an analogous S-loop via arcs 58*i* and 48*i*. In this way two linked pairs of arcs 47*i*/57*i* and 48*i*/58*i* are formed, each of which transmits an opposite moment in mandrel 41*i* to the concrete. The vectors of the compressive forces arising in the concrete are directed slightly rearwards in arc sections 47*i* and 48, and slightly forward in arc sections 57*i*, 58*i*.The strip is connected to the mandrel at the point where it passes said mandrel, e.g. by a weld. So that the strip describes a favorable curve it can be formed from a strip which is curved in extended form or which is even not a flat strip.

Figure 15:
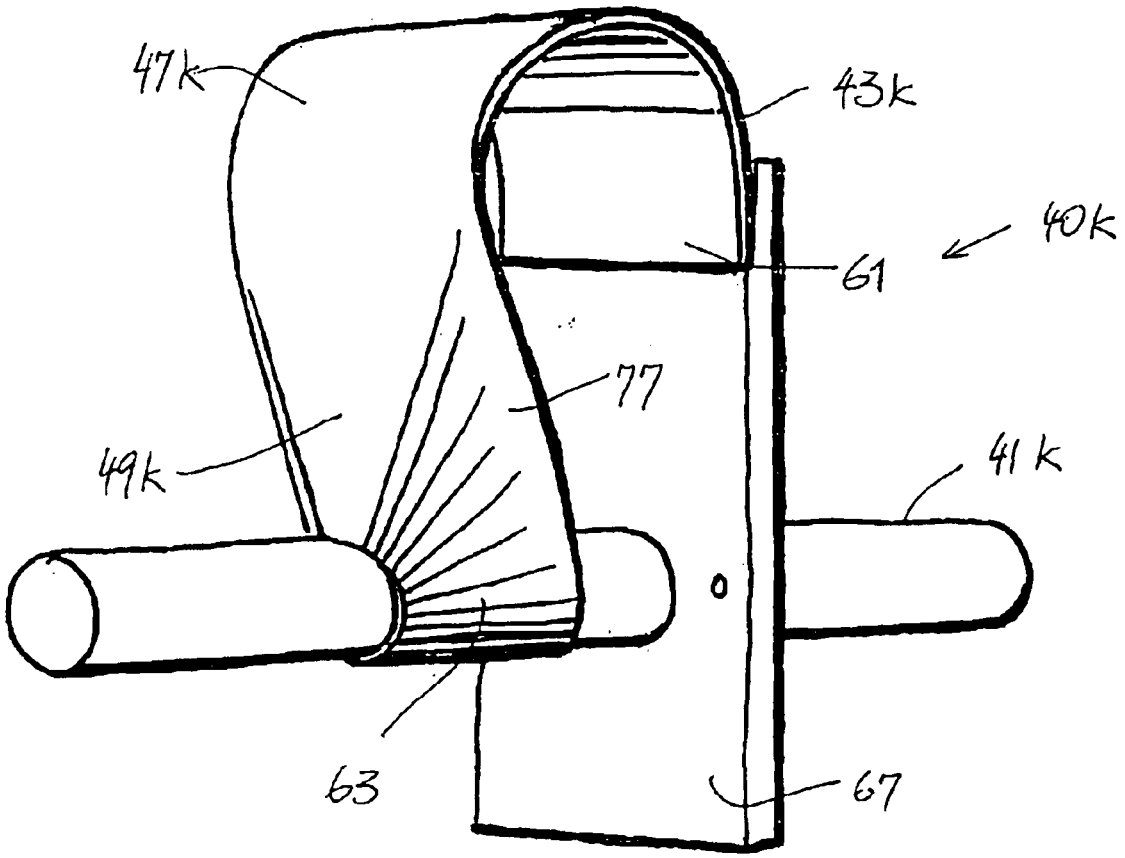
FIG. 15 is a perspective sketch of a shear force element with a loop of flat material surrounding the mandrel in a planar fashion.

FIG. 15 shows a perspective sketch of a shear force element 40*k* with a plate 67, a loop element 43*k* and a round mandrel 41*k*. The end 61 of the loop element 43*k* is fixed to plate 67. The other end 63 is divided and the two flanks 77 of leg section 49*k* are bent obliquely, so that they rest against the mandrel on a line parallel to the axis of the mandrel. The two parts are fitted snugly around the mandrel 41*k*. The flanks 77 are joined together along the mandrel. The strap-shaped loop element passes around the mandrel with its side face, whereby larger forces can be transmitted by the mandrel to the loop element than if the mandrel merely passed through an opening in the strip.

Figure 16:
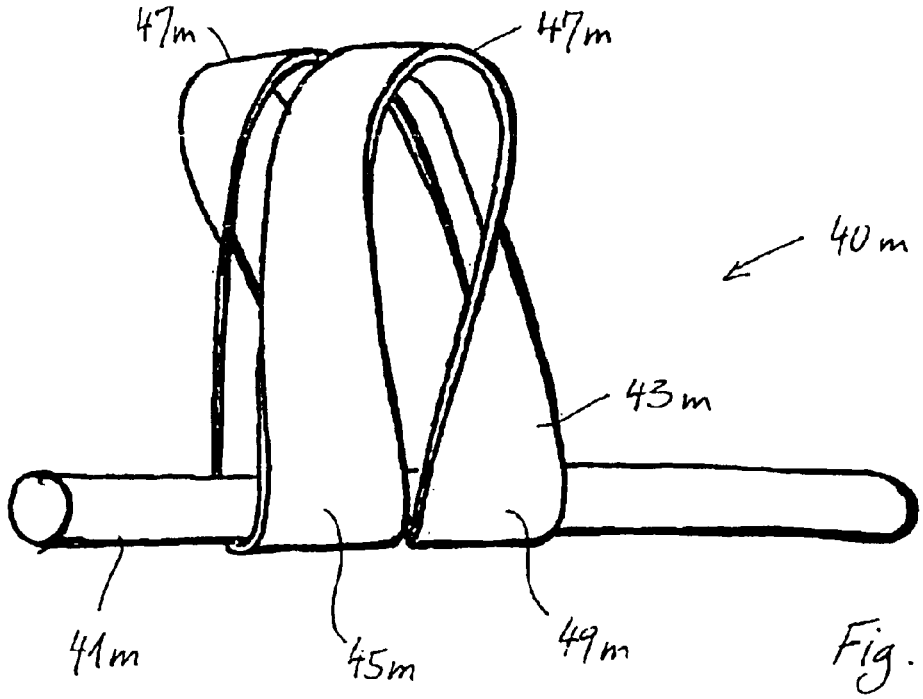
FIG. 16 is a perspective sketch of a shear force element with an annular strap wound around the mandrel.
Figure 17:
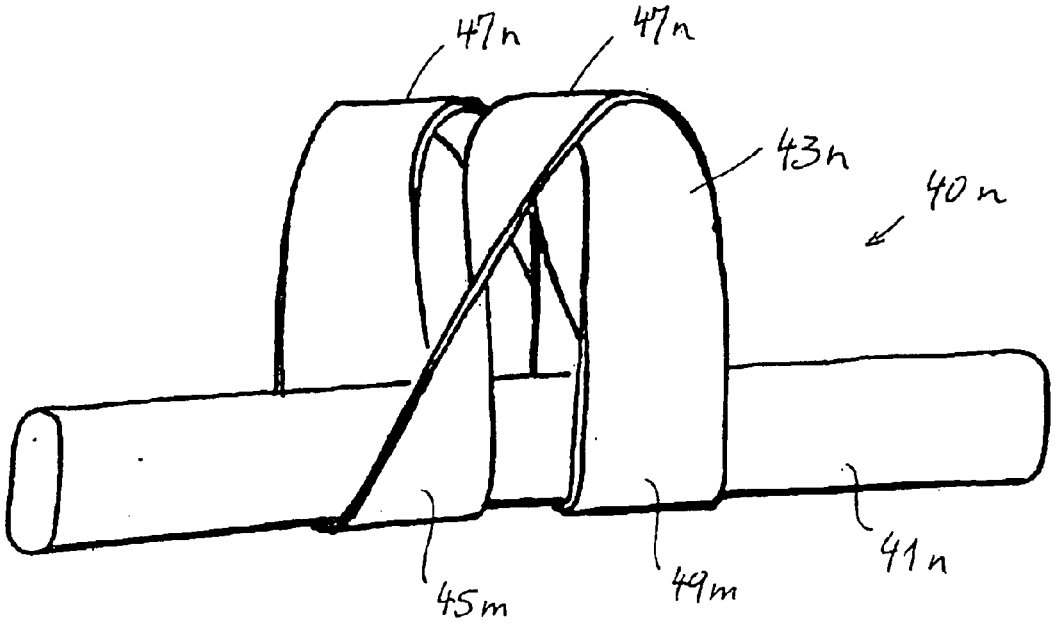
FIG. 17 is a perspective sketch of a shear force element as in FIG. 16, but with inverse twisting of the annular strap.

In a similar way the loop elements 43*m* and 43*n* in shear force elements 40*m* and 40*n* are connected to the mandrels 41*m,n* (FIGS. 16 and 17). A closed strip loop or annular loop 43*m,n* is wound around the rod-shaped mandrel 41*m,n* and forms two loop sections 47*m* and 47*n* respectively, which loop sections are located together and are orientated in substantially the same direction. The annular loops 43*m,n* can be twisted towards each other (FIG. 16) or away from each other (FIG. 17). Such attachments of shear force elements 40*m,n* are also very suitable for loop elements 43*m,n* made of non-metallic raw materials. For example, the strip can consist of a mesh of glass or carbon fibers which are advantageously embedded in a resin.

Figure 18:
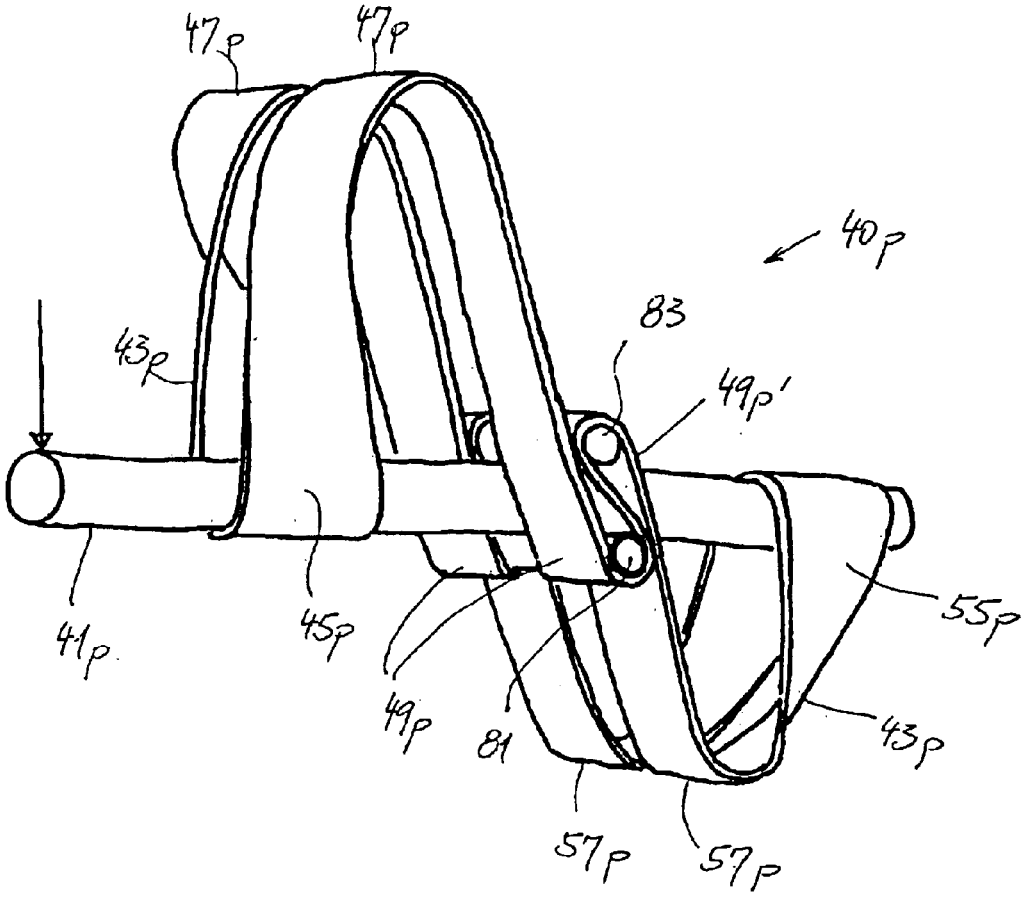
FIG. 18 is a perspective view of a shear force element with an S-shaped double loop formed from an annular strap.

The shear force element 40*p* shown in FIG. 18 has a mandrel 41*p* around which an annular loop 43*p* is so arranged that the loop 43*p* is passed under the mandrel 41*p* while resting flat against mandrel 41*p*. On either side of the mandrel the strap of the loop element is twisted through 90 degrees and is formed into an arc 47*p*, as if laid around a roller with its axis aligned parallel to the side face of the slab, and then passes back towards the axis of the mandrel. Strap 43*p* is then looped around two rods aligned parallel to the slab face on either side of mandrel 41*p*. Strap 43*p* first runs under a rod 81, which rod 81 is fixed to the mandrel below the mandrel. Then the strap 43*p* is folded back upwards in an S-shape and passed around a rod 83 which is fixed to mandrel 41*p* above said mandrel. The annular strap 43*p* then runs parallel downwards and rearwards on either side of the mandrel 41*p*, past mandrel 41*p*, and then forms two matching arc sections 57*p* below mandrel 41*p*, and, twisted through 90 degrees, finally passes around the mandrel while resting with its flat face on the upper side of mandrel 41*p*. The passing of the strap around two rods 81, 83 has the effect that the tensile forces in the front part 47*p* of the loop are not transmitted to the rear part 57*p* of the loop. If the strap were not joined to the mandrel in the middle, the tensile forces arising in the front zone of the strap would also be transmitted to the rearward part of the strap. Seen in terms of a model, the mandrel would thereby be displaceable downwards in a parallel direction, i.e. greater tensile forces would arise, firstly, in the rear zone of the strap and, secondly, greater compressive forces would be exerted by the mandrel on the concrete.

If a shear force now acts on the embedded shear force mandrel 41*p* in the direction of arrow 53, tension is exerted on loop element 43*p* both rearwards and near the surface of the concrete. This tension is transmitted to the strap 43*p* via the loop resting on the mandrel surface, and is passed on to the concrete present inside the loops 47*p*, 57*p* by means of arc sections 47*p* and 57*p* respectively. The loop element 43*p* is under tensile load without exception and along its entire length. Simply because of its dimensions, bending forces cannot be transmitted. The concrete inside the arc sections 47*p*, 57*p* is compressed from three sides. The three-dimensional compression permits higher local pressure.

FIG. 19 shows a prefabricated edge element 10" with a number of shear force elements, of which only the parts of the shear force mandrels 41 projecting from the front face 11 are visible. At the sides, which are cast with site-mixed concrete, reinforcements 85 project. These reinforcements are partly embedded in concrete body 10" and are partly connected to the reinforcement of the adjacent slab and are embedded in site-mixed concrete, after element 10" has been installed.

What is claimed is:

1. A method for introducing a shear force into a concrete body comprising:

(1) introducing the shear force into a shear force rod axially extending through a surface of the concrete body into the concrete body, said shear force rod being one of a shear force mandrel and a sleeve around the shear force mandrel;

(2) diverting the shear force from the shear force rod by at least one shear force strap completely in the concrete body and each connected to said shear force rod at (1) at least one first fixing point close to the surface of the concrete body and at (2) at least one second fixing point distant from the surface of the concrete body, each shear force strap comprising one or more loop elements extending from one of the first fixing points to one of the second fixing points, each loop element forming one single arc section between said first and said second fixing point, the arc section being formed around a concrete core that is being part of the concrete body; and (3) transmitting the shear force into the concrete body by substantially only tensile forces in the shear force strap or straps.

2. The method according to claim 1, wherein the concrete body is a concrete slab.

3. The method of claim 2, wherein the shear force is introduced into the side face of the concrete slab.

4. The method according to claim 3, wherein an additional fiber reinforcement is provided to the concrete slab for distributing the tensile forces arising in the concrete slab.

5. An element for introducing a shear force into a concrete body comprising the combination of:

(a) at least one shear force rod axially extending through a surface of the concrete body into the concrete body, each said shear force rod being one of a shear force mandrel and a sleeve around the shear force mandrel; and (b) at least one shear force strap completely within the concrete body and each attached to said shear force rod at (1) at least one first fixing point close to the surface of the concrete body and at (2) at least one second fixing point distant from the surface of the concrete body; each said shear force strap capable of transmitting the shear force to the concrete body and comprising one or more loop elements extending from one of said first fixing points to one of said second fixing points, each loop element forming one single arc section between said first and said second fixing point.

6. An element according to claim 5, wherein each loop element is sufficiently flexible under the forces arising under load that it absorbs substantially only tensile forces.

7. An element according to claim 5, wherein each loop element has a substantially symmetrical arc section.

8. An element according to claim 5, wherein the arc section of each loop element is formed by a curved planar element of the loop element.

9. An element according to claim 8, wherein each loop element is formed of strip material which is relatively wide in relation to its thickness.

10. An element according to claim 5, wherein two loop elements are formed and are attached to the shear force rod.

11. An element according to claim 5, wherein two loop element are formed symmetrically with respect to the axis of the shear force rod.

12. An element according to claim 7, wherein rearwards of a first loop element a second loop element is arranged, the arc section of the second loop element being aligned in the opposite direction with respect to the arc section of said first loop element.

13. An element according to claim 5, and wherein the concrete body is reinforced with fiber reinforcement.

14. A method for introducing shear forces into a concrete body comprising:

(1) introducing the shear force into a shear force rod axially extending through a surface of the concrete body into the concrete body, said shear force rod being one of a shear force mandrel and a sleeve around the shear force mandrel;

(2) diverting the shear force from the shear force rod by at least one shear force strap, each connected to the shear force rod at two or more fixing points, each shear force strap comprising one or more loop elements extending from a first fixing point more close to the surface of the concrete body to a second fixing point more distant from the surface of the concrete body, each loop element forming one single arc section between said first and said second fixing point around a concrete core, the concrete core being part of the concrete body; and (3) transmitting the shear force into the concrete body by substantially only tensile forces in the shear force strap or straps.

15. An element for introducing shear forces into a concrete body comprising the combination of:

(a) a first shear force rod being a shear force mandrel; and (b) at least one first shear force strap attached to said shear force mandrel at two or more fixing points; each said first shear force strap comprising one or more loop elements extending from a first fixing point to a second fixing point, each loop element forming one single arc section between said first and said second fixing point;

(c) a second shear force rod being a sleeve around the shear force mandrel; and (d) at least one second shear force strap attached to said sleeve at two or more fixing points; each said second shear force strap comprising one or more loop elements extending from a first fixing point to a second fixing point, each loop element forming one single arc section between said first and said second fixing point.

16. An element according to claim 15, wherein each loop element is sufficiently flexible under the forces arising under load that it absorbs substantially only tensile force.

17. An element according to claim 15, wherein each loop element has a substantially symmetrical arc section.

18. An element according to claim 15, wherein the arc section of each loop element is formed by a curved planar element of the loop element.

19. An element according to claim 15, wherein each loop element is formed of strip material which is relatively wide in relation to its thickness.

20. An element according to claim 15, wherein two loop elements are formed and are attached to the shear force mandrel.

21. An element according to claim 20, wherein two loop elements are formed symmetrically with respect to the axis of the shear force mandrel.

22. An element according to claim 15, wherein two loop elements are formed and are attached to the sleeve.

23. An element according to claim 22, wherein two loop elements are formed symmetrically with respect to the axis of the sleeve.

24. A method for introducing a shear force into a concrete body, said shear force working between the concrete body and a second body distinct from the concrete body, said concrete body and said second body being connected by at least one shear force rod extending along a longitudinal axis, said shear force rod consisting of a shear force mandrel and a sleeve around said mandrel, said shear force mandrel having a first portion and adjacent to said first portion on said longitudinal axis a second portion, and said sleeve being arranged around and fitted to said first portion, said concrete body being connected to said sleeve around said first portion of the shear force mandrel and said second body being connected to said second portion of said shear force mandrel, said method comprising the steps of:

(1) connecting each of at least one shear force strap at first and second spaced apart fixing points to said sleeve such that the shear force strap forms at least one arc-like loop element extending from one of the first fixing points to one of the second fixing points;

(2) arranging the shear force rod such that each shear force strap can be embedded in the concrete body to be molded and that the first fixing point is close to the surface of the concrete body and the second fixing point is distant from the surface of the concrete body to be molded, and that the second portion of the shear force mandrel is arranged outside the concrete body to be molded;

(3) embedding the shear force strap connected to the shear force rod in a concrete made forming after curing said concrete body, wherein each arc-like loop element encloses a concrete core that is part of the concrete body;

(4) connecting said second body to said second portion of said shear force mandrel such that a potential shear force acting between said concrete body and said second body is introduced into said concrete body by said shear force rod, provoking tensile forces only in the arc-like loop element enclosing said concrete core.

25. A method for introducing a shear force into a concrete body, said shear force working between the concrete body and a second body distinct from the concrete body, said concrete body and said second body being connected by at least one shear force rod extending along a longitudinal axis, said shear force rod consisting of a shear force mandrel and a sleeve around said mandrel, said shear force mandrel having a first portion and adjacent to said first portion on said longitudinal axis a second portion, and said sleeve being arranged around and fitted to said second portion, said concrete body being connected to said first portion of the shear force mandrel and said second body being connected to said sleeve around said second portion of said shear force mandrel, said method comprising the steps of:

(1) connecting each of at least one shear force strap at first and second spaced apart fixing points to said first portion of said shear force mandrel such that the shear force strap forms at least one arc-like loop element extending from one of the first fixing points to one of the second fixing point;

(2) arranging the shear force rod such that each shear force strap can be embedded in the concrete body to be molded and that the first fixing point is close to the surface of the concrete body and the second fixing point is distant from the surface of the concrete body to be molded, and that the second portion of the shear force mandrel is arranged outside the concrete body to be molded;

(3) embedding the shear force strap connected to the shear force rod in a concrete mass forming after curing said concrete body, wherein each arc-like loop element encloses a concrete core that is part of the concrete body;

(4) connecting a second distinct body to said sleeve such that a potential shear force acting between said concrete body and said second body is introduced into the concrete body by the shear force rod, provoking tensile forces only in the arc-like loop elements enclosing said concrete core.

26. An element for introducing shear forces from outside of a concrete body by a shear force mandrel through a surface of said concrete body into said concrete body, comprising the combination of:

(1) said shear force mandrel extending along its longitudinal axis and having a first portion and on said longitudinal axis adjacent to said first portion a second port; and (2) a sleeve arranged and fitting around said first portion of said shear force mandrel, said shear force mandrel and said sleeve being movable relative to each other along said longitudinal axis;

(3) at least one first shear force strap, each attached at two or more fixing points to said sleeve around said first portion of said shear force mandrel;

(4) each first shear force strap comprising one first loop element extending from a first fixing point close to said second portion of said shear force mandrel to a second fixing point more distant from said second portion of said shear force mandrel, said loop element being formed of strip material being formed of strip material and forming one single continuous arc section between said first and said second fixing point.

27. An element for introducing shear forces from outside of a concrete body by a shear force mandrel through a surface of said concrete body into said concrete body, comprising the combination of:

(1) said shear force mandrel extending along a longitudinal axis and having a first portion and on said longitudinal axis adjacent to said first portion a second portion; and (2) a sleeve arranged and fitting around said first portion of said shear force mandrel, said shear force mandrel and said sleeve being movable relative to each other along said longitudinal axis;

(3) at least one second shear force strap, each attached at two or more fixing points to said second portion of said shear force mandrel;

(4) each of said second shear force straps comprising one first loop element extending from a first fixing point close to said first portion of said shear force mandrel to a second fixing point more distant from said first portion of said shear force mandrel, said loop element being formed of strip material being formed of strip material and forming one single continuous arc section between said first and said second fixing point.

* * * * *